US008281924B2

(12) United States Patent
Westrup

(10) Patent No.: US 8,281,924 B2
(45) Date of Patent: Oct. 9, 2012

(54) COVER FOR PORTABLE ELECTRONIC DEVICE

(75) Inventor: Joseph Westrup, Vancouver, WA (US)

(73) Assignee: Cyber Acoustics, LLC, Vancouver, WA (US)

( * ) Notice: Subject to any disclaimer, the term of this patent is extended or adjusted under 35 U.S.C. 154(b) by 0 days.

(21) Appl. No.: 12/860,808

(22) Filed: Aug. 20, 2010

(65) Prior Publication Data

US 2012/0043234 A1 Feb. 23, 2012

(51) Int. Cl.
*B65D 85/00* (2006.01)

(52) U.S. Cl. ..... 206/320; 206/472

(58) Field of Classification Search ..... 206/320, 206/565, 479, 424, 312; 248/609; 150/123, 150/165, 107; 402/8, 18, 500; 281/19.2, 281/12, 23, 4, 2, 48, 31, 29; 190/902, 10, 190/11, 900, 122
See application file for complete search history.

(56) References Cited

U.S. PATENT DOCUMENTS

| | | | | |
|---|---|---|---|---|
| 549,890 | A * | 11/1895 | Austin | 281/17 |
| 2,989,023 | A * | 6/1961 | Ellingsen | 116/237 |
| 4,778,201 | A * | 10/1988 | Kouno et al. | 281/42 |
| 6,616,111 | B1 * | 9/2003 | White | 248/309.1 |
| 2004/0173482 | A1 * | 9/2004 | Nieves | 206/320 |
| 2006/0060485 | A1 * | 3/2006 | Picot et al. | 206/320 |
| 2007/0114783 | A1 * | 5/2007 | Glosh et al. | 281/29 |
| 2007/0119735 | A1 * | 5/2007 | Moser | 206/320 |
| 2008/0237432 | A1 * | 10/2008 | Patterson | 248/458 |
| 2010/0072334 | A1 * | 3/2010 | Le Gette et al. | 248/176.3 |
| 2010/0122924 | A1 * | 5/2010 | Andrews | 206/320 |
| 2010/0294683 | A1 * | 11/2010 | Mish et al. | 206/320 |
| 2012/0153116 | A1 * | 6/2012 | Harrison | 248/460 |

FOREIGN PATENT DOCUMENTS

DE 20 2007 008 882 U1 11/2007

* cited by examiner

*Primary Examiner* — Mickey Yu
*Assistant Examiner* — Rafael Ortiz
(74) *Attorney, Agent, or Firm* — Chernoff, Vilhauer, McClung & Stenzel LLP

(57) ABSTRACT

A portfolio-style protective cover for portable electronic devices is disclosed.

4 Claims, 4 Drawing Sheets

COVER FOR PORTABLE ELECTRONIC DEVICE

BACKGROUND OF THE INVENTION

The development of devices incorporating electronic devices has been explosive over the past decade, resulting in many new genres of battery-powered products such as so-called "smart phones," electronic readers, and, more recently, the Apple iPad®. All such devices are relatively lightweight and portable, owing to the miniaturization of electronic components and circuitry. One shortcoming of such small scale is that the circuitry is relatively fragile and so subject to damage by, for example, impact with a hard surface caused by dropping and/or exposure to moisture. There is therefore a need in the art for protection of such devices from such damage. This need is met by the present invention.

BRIEF SUMMARY OF THE INVENTION

According to the present invention, there is provided a protective cover for portable electronic devices that has a number of unique and useful features that protect such devices from damage and provide support for operating such devices from a desktop or similar flat surface.

DETAILED DESCRIPTION OF PREFERRED EMBODIMENT

Figure 1:
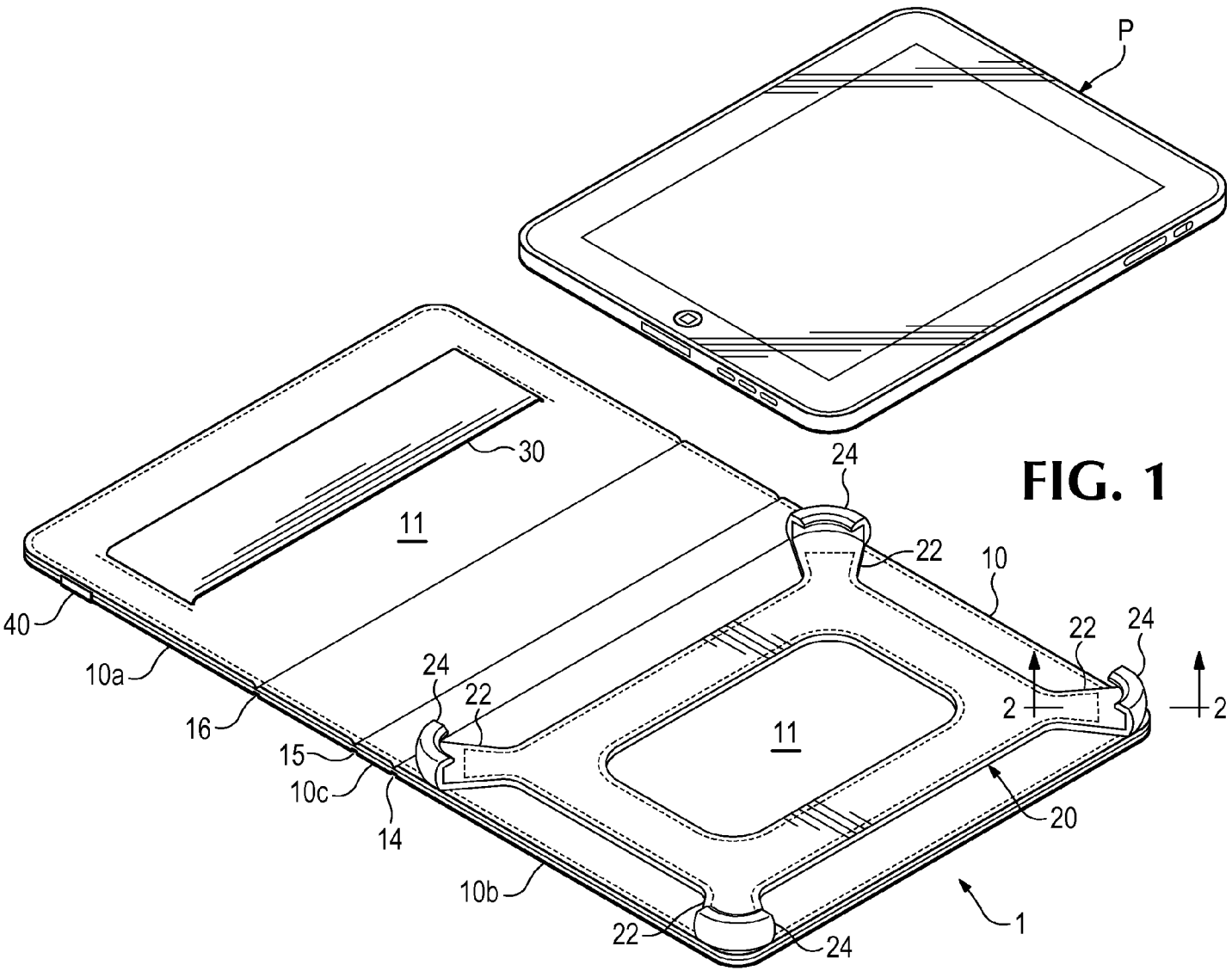
FIG. 1 is a top perspective view of an exemplary cover of the invention opened to receive an electronic device P such as an Apple iPad®.
Figure 3:
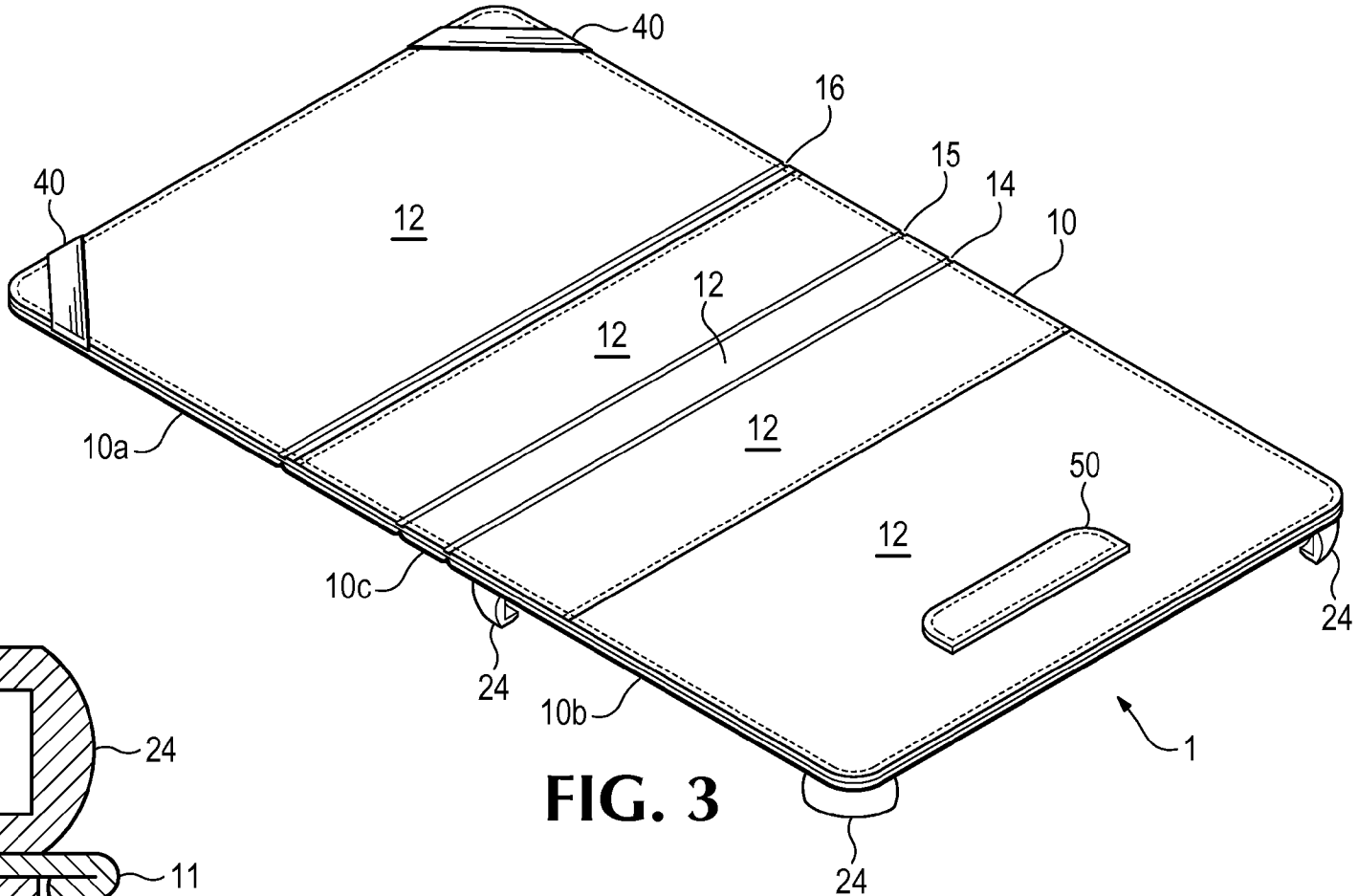
FIG. 3 is a top perspective view of the outside of the cover shown in FIG. 1.
Figure 2:
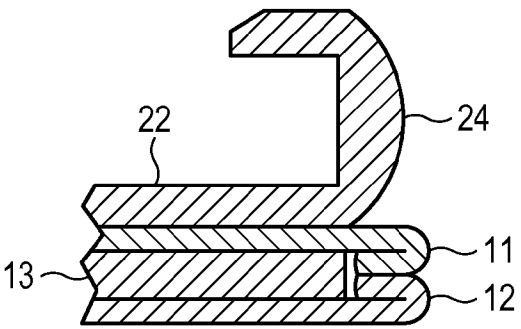
FIG. 2 is a sectional taken through the plane 2-2 of FIG. 1.

Referring to the drawings, wherein the same numerals generally refer to the same elements, there is shown a cover 1 designed to accept an electronic device P, the cover comprising a foldable portfolio 10 having a top 10*a*, a bottom 10*b*, and a spine 10*c*. The top 10*a* and bottom 10*b* preferably comprise a three-ply lamination of a soft layer 11 such as felt on the inside of the portfolio that is in contact with the electronic device P, a durable outside layer 12 such as leather, and a stiff middle layer 13 to provide structural support to the top and bottom of the cover. Spine 10*c* preferably comprises only two plies 11 and 12 so as to maintain flexibility on opening and closing. Portfolio 10 is preferably provided with longitudinal creases 14, 15 and 16 to further facilitate flexing, with crease 16 being created by a discontinuity in middle layer 13.

A prominent feature of cover 1 is a generally rectangular O-shaped frame 20 on the inside of the bottom 10*b* that provides structural support. Frame 20 is provided with four legs 22 integral with frame 20 extending radially outwardly from the four corners of frame 20 to the four corners of bottom 10*b*. Legs 22 terminate in four resilient lugs 24 adapted to capture the four corners of electronic device P and hold the same securely in place against bottom 10*b*. Lugs 24 serve a second purpose, which is to absorb shock in the event the combined cover and electronic device P is struck or dropped onto a hard surface.

Figures 4, 5:
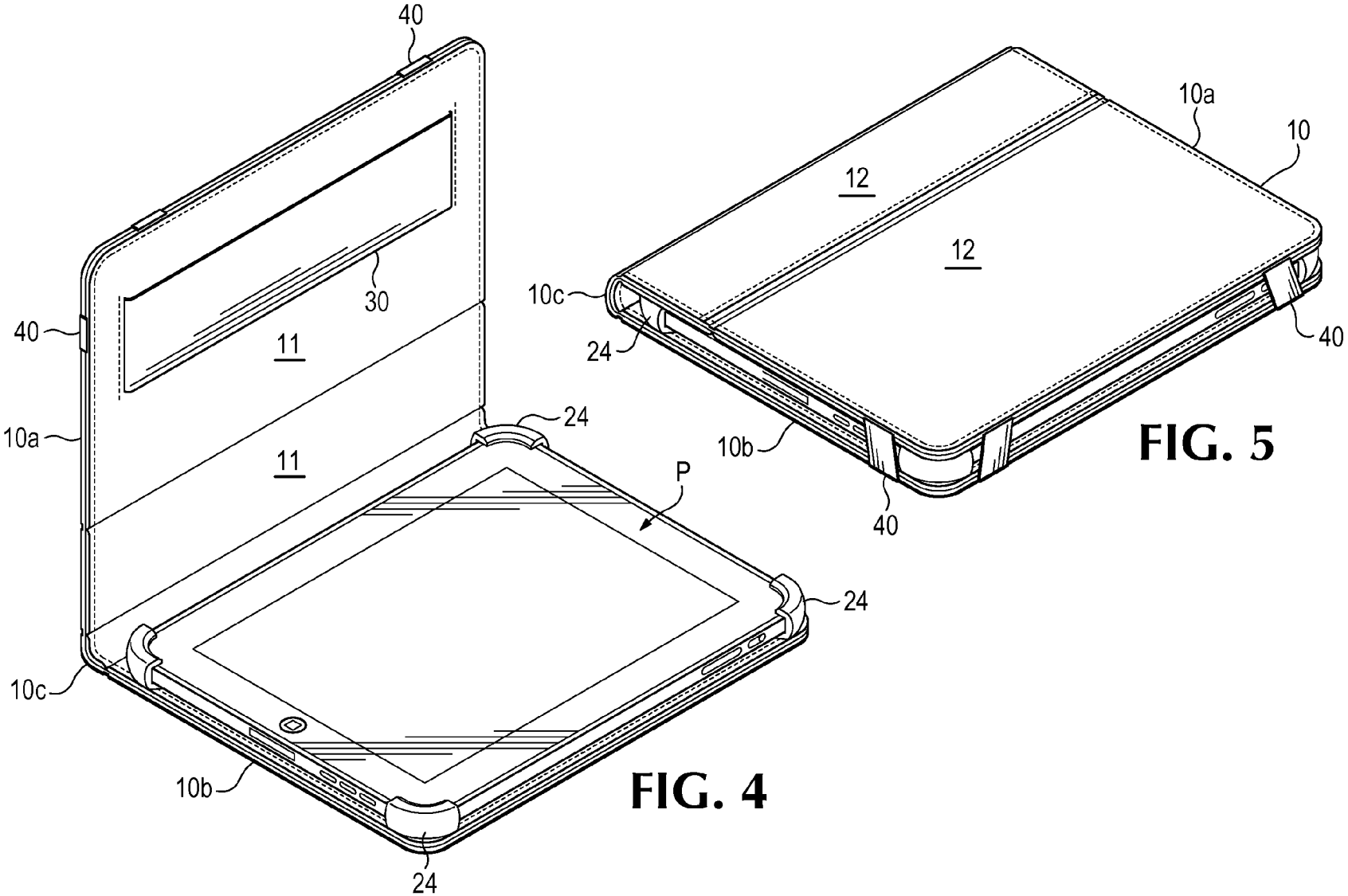
FIG. 4 is a top perspective view of the cover of FIG. 1 with the electronic device P inserted into the cover and the top of the cover partially open.
FIG. 5 is a top perspective view of the cover of FIG. 1 closed and secured over the electronic device.
Figure 6:
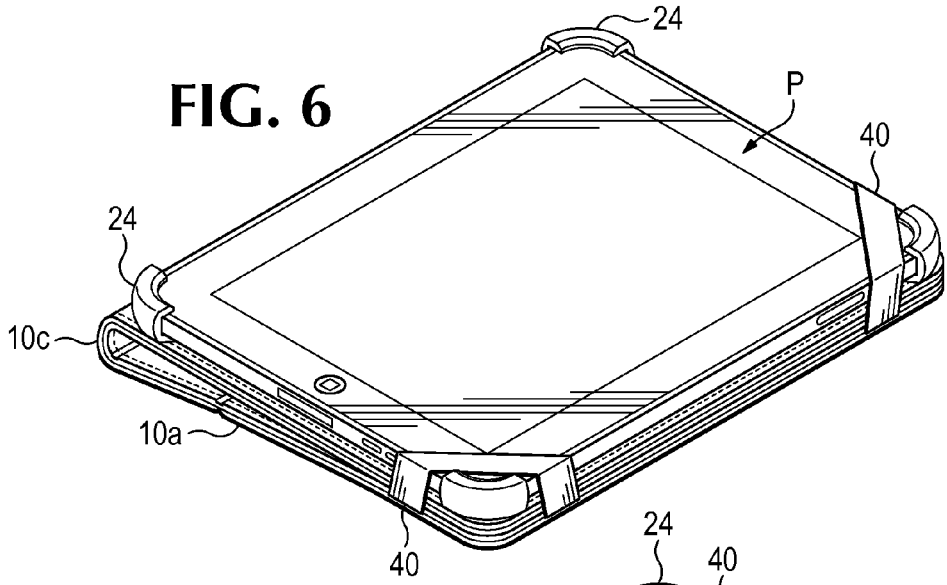
FIG. 6 is a top perspective view of the cover of FIG. 1 with the electronic device P inserted into the cover and the top of the cover folded back and secured to the bottom of the cover.
Figure 7:
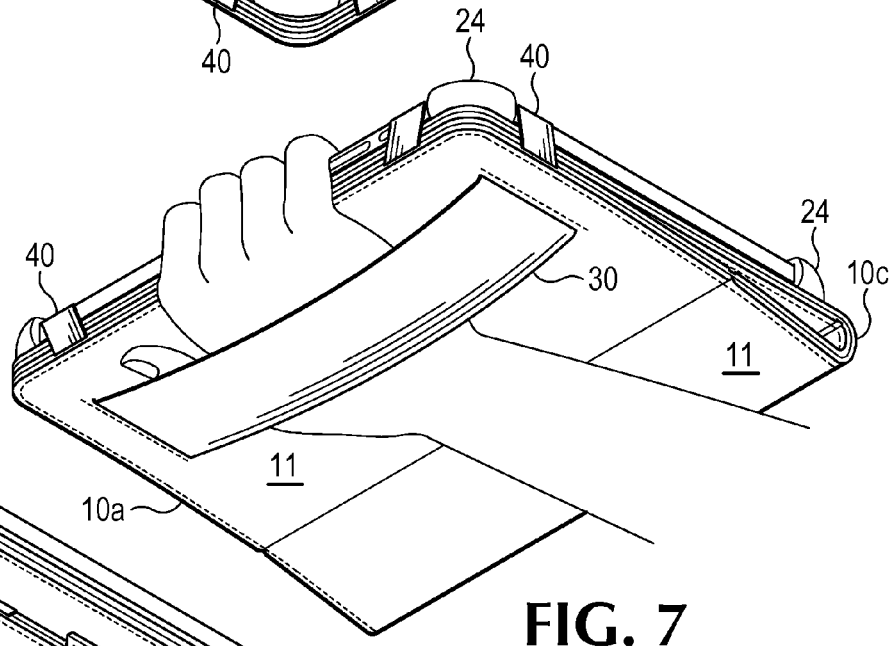
FIG. 7 is a bottom perspective view of the arrangement shown in FIG. 6 illustrating the utility of a hand strap secured to the inside of the top of the cover.

Top 10*a* is preferably provided at its corners with reversible elastic straps 40 that may be secured to bottom 10*b* at corresponding corners to secure cover 1 in a closed or open position, best seen in FIGS. 5 and 6, respectively. Preferably such reversible straps 40 are attached to bottom 10*b* by sewing their ends between layers 11 and 12. Top 10*a* is further provided with an elastic handle strap 30 on its inside surface 11, which may be deployed by the user to maintain a secure grip on the cover and device P so as to decrease the likelihood of dropping the same.

Figure 8:
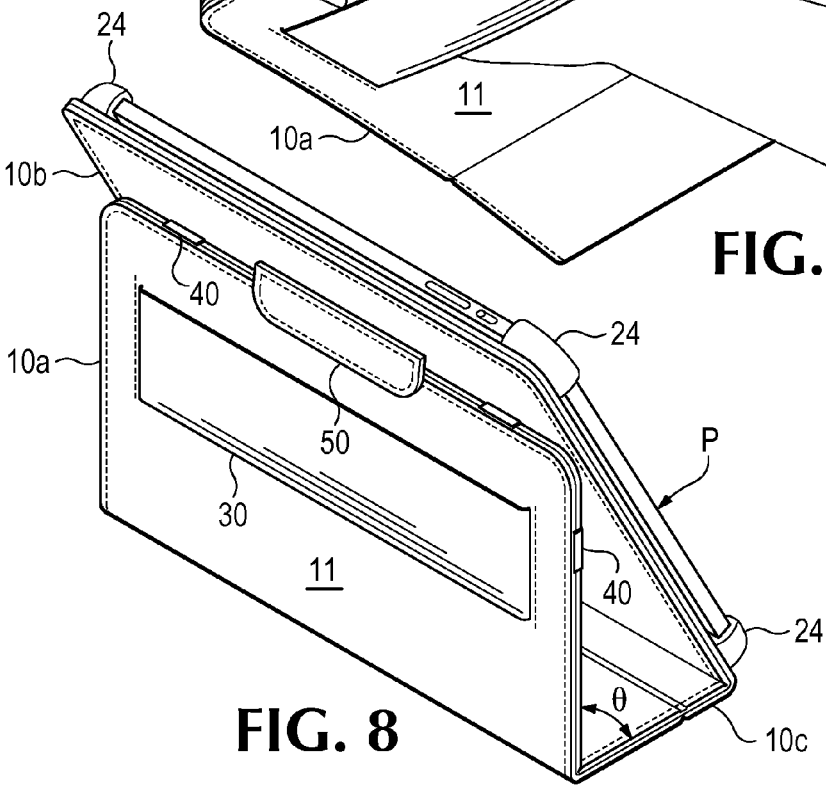
FIG. 8 is a top perspective view of the cover of FIG. 1 with the electronic device P inserted into the cover and the top folded back on itself to tuck into a flap on the outside of the bottom of the cover, so as to create a stand for the electronic device P.

Finally, bottom 10*b* is preferably provided with a flap 50 designed to capture the outside edge of top 10*a* when the same is folded back on itself along crease 16 at an angle θ of about 90° so as to create an easel or stand for the entire arrangement, best seen in FIG. 8.

Thus, cover 1 may be secured to any of a wide variety of portable, generally rectangular electronic devices, including, without limitation, "smart phones," e-readers, e-planners, e-calendars, and e-tablets such as the Apple iPad® to protect the device while maintaining easy access to the device by the user.

The terms and expressions which have been employed in this specification are used therein as terms of description and not of limitation, and there is no intention in the use of such terms and expressions to exclude equivalents of the features shown and described or portions thereof, it being recognized that the scope of the invention is defined and limited only by the claims which follow.

What is claimed is:

1. A protective cover for electronic devices comprising:

(a) a foldable portfolio having a top and a bottom with corners on said top and said bottom;

(b) a four-legged frame secured to the inside of said bottom;

(c) the four legs of said four-legged frame oriented in an X-shaped configuration relative to each other; and (d) resilient corner-engaging lugs integral with each of said four legs;

(e) a flap on the outside of said bottom; and (f) a hinge integral with said top that permits said top to be partially opened to an angle of about 90° relative to the remainder of said top and to engage said flap.

2. The cover of claim 1 wherein said top and said bottom comprise three plies of (i) a soft inside layer; (ii) a durable outside layer; and (iii) a stiff middle layer.

3. The cover of claim 2 further comprising reversible elastic straps secured to the corners of said top.

4. The cover of claim 3 further comprising an elastic strap secured to the inside of said top.

* * * * *

UNITED STATES PATENT AND TRADEMARK OFFICE
Certificate

Patent No. 8,281,924 B2

Patented: October 9, 2012

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Steven Murphy, Vancouver, WA (US); Kwong Chi Kei, Hong Kong (CH); and Lui Suen Yen, Hong Kong (CH).

Signed and Sealed this Twenty-seventh Day of May 2014.

MICKEY YU
*Supervisory Patent Examiner*
Art Unit 3728
Technology Center 3700